US009918533B2

(12) United States Patent
Copek et al.

(10) Patent No.: US 9,918,533 B2
(45) Date of Patent: Mar. 20, 2018

(54) CARRYING CASE

(71) Applicant: PB Products LLC, Almont, MI (US)

(72) Inventors: Diane Lynn Copek, Dryden, MI (US); Aaron Lown, Tuxedo, NY (US); Michael Joseph Byrne, Grand Blanc, MI (US)

(73) Assignee: PB Products LLC, Almont, MI (US)

( * ) Notice: Subject to any disclaimer, the term of this patent is extended or adjusted under 35 U.S.C. 154(b) by 0 days.

(21) Appl. No.: 14/731,754

(22) Filed: Jun. 5, 2015

(65) Prior Publication Data

US 2016/0021995 A1 Jan. 28, 2016

Related U.S. Application Data

(60) Provisional application No. 62/029,122, filed on Jul. 25, 2014.

(51) Int. Cl.
*A45C 7/00* (2006.01)
*A45C 5/00* (2006.01)
(Continued)

(52) U.S. Cl.
CPC ..... *A45C 7/0036* (2013.01); *A45C 5/005* (2013.01); *A45C 7/0031* (2013.01);
(Continued)

(58) Field of Classification Search
CPC ..... A45C 7/0086; A45C 7/0045; A45C 11/20; A45C 11/008; A45C 2011/007;
(Continued)

(56) References Cited

U.S. PATENT DOCUMENTS

D111,539 S 9/1938 Graff
3,858,592 A 1/1975 Rickenbaker
(Continued)

FOREIGN PATENT DOCUMENTS

CN 203618952 U 6/2014
WO 2010017548 A2 2/2010
WO 2011112284 A1 9/2011

OTHER PUBLICATIONS

International Search Report and Written Opinion for PCT/US2015/041673 dated Oct. 9, 2015 (12 pages).
(Continued)

*Primary Examiner* — Steven A. Reynolds
*Assistant Examiner* — Mollie Impink
(74) *Attorney, Agent, or Firm* — Miller Canfield Paddock and Stone; Mark L Maki

(57) ABSTRACT

A carrying case includes a first storage unit and a second storage unit. The second storage unit is moveable away from the first storage unit from a stowed position to an extended position to define a gap between the first storage unit and the second storage unit in the extended position. A tray extends across the gap from the first storage unit to the second storage unit. At least a portion of the tray is disposed in the second storage unit in the stowed position and extends along the gap in the extended position. Contents of the first storage unit and/or the second storage unit may be removed from the storage unit and supported on the tray during use of the contents.

21 Claims, 9 Drawing Sheets

(51) Int. Cl.

| | |
|---|---|
| ***A45C 11/00*** | (2006.01) |
| ***A45C 11/20*** | (2006.01) |
| ***A45C 13/00*** | (2006.01) |
| ***A45C 13/10*** | (2006.01) |
| *A45C 3/00* | (2006.01) |
| *A45C 13/02* | (2006.01) |

(52) U.S. Cl.
CPC ..... *A45C 7/0072* (2013.01); *A45C 11/008* (2013.01); *A45C 11/20* (2013.01); *A45C 13/004* (2013.01); *A45C 13/005* (2013.01); *A45C 13/02* (2013.01); *A45C 13/10* (2013.01); *A45C 2003/005* (2013.01); *A45C 2007/0013* (2013.01); *A45C 2011/007* (2013.01); *A45C 2013/026* (2013.01)

(58) Field of Classification Search
CPC ..... A45C 5/005; A45C 2003/005; A45C 2003/008; A45C 2009/007; A45C 2007/0004; A45C 2200/15; A45C 7/0031; A45C 7/0072; A45C 7/0095; A45C 7/0054; B65D 21/02; B65D 21/0201; B25H 3/06
USPC ..... 190/1, 108, 109; 383/4, 37, 38
See application file for complete search history.

(56) References Cited

U.S. PATENT DOCUMENTS

| | | | | |
|---|---|---|---|---|
| 3,989,174 | A * | 11/1976 | Norinsky | A45C 3/00 190/902 |
| 4,580,586 | A | 4/1986 | Kitoh et al. | |
| D284,424 | S | 7/1986 | Gotlib | |
| 4,744,376 | A | 5/1988 | Verducci | |
| D301,802 | S | 6/1989 | Young | |
| 4,890,728 | A * | 1/1990 | Grimsley | A45C 1/06 150/147 |
| 4,898,195 | A | 2/1990 | Sussman | |
| 4,936,463 | A | 6/1990 | Tiramani | |
| 5,054,505 | A | 10/1991 | Yuhara | |
| D322,865 | S | 12/1991 | Favre | |
| D324,453 | S | 3/1992 | DiSessa | |
| D370,123 | S | 5/1996 | Klinger | |
| 5,632,394 | A | 5/1997 | Mecca et al. | |
| D381,199 | S | 7/1997 | Glasser | |
| 5,676,240 | A | 10/1997 | Cziraky et al. | |
| 5,845,658 | A | 12/1998 | Sussman | |
| 5,862,816 | A | 1/1999 | Lowe | |
| 5,941,255 | A | 8/1999 | Chen | |
| 6,109,443 | A | 8/2000 | Dercole | |
| 6,138,686 | A | 10/2000 | Yuhara | |
| 6,378,533 | B1 | 4/2002 | Roman | |
| D461,046 | S | 8/2002 | Cohen | |
| 6,532,969 | B2 | 3/2003 | Nuzzo | |
| 6,540,083 | B2 | 4/2003 | Shih | |
| 6,554,001 | B1 | 4/2003 | Godshaw | |
| D474,889 | S | 5/2003 | Ko | |
| 6,640,813 | B2 | 11/2003 | Raisner et al. | |
| D488,928 | S | 4/2004 | Foley | |
| 6,722,496 | B2 * | 4/2004 | Gantert | A45C 3/00 206/315.11 |
| 6,843,385 | B2 * | 1/2005 | Gardi | A45C 7/0031 220/23.86 |
| 7,014,045 | B2 | 3/2006 | Lin | |
| 7,040,486 | B2 | 5/2006 | Godshaw et al. | |
| D525,790 | S | 8/2006 | Heroux | |
| D573,793 | S | 7/2008 | Bakker | |
| 7,588,146 | B1 * | 9/2009 | Salander | A45C 11/00 190/110 |
| 7,849,863 | B2 | 12/2010 | Corbellini | |
| D631,201 | S | 1/2011 | Lai | |
| D631,202 | S | 1/2011 | Chen | |
| D632,079 | S | 2/2011 | Spencer | |
| 8,091,565 | B2 | 1/2012 | Ramos | |
| 8,156,948 | B2 | 4/2012 | Oreal | |
| D660,518 | S | 5/2012 | Chen | |
| D669,270 | S | 10/2012 | Phillips | |
| 8,286,646 | B2 | 10/2012 | Son | |
| D688,006 | S | 8/2013 | Lai | |
| D690,055 | S | 9/2013 | Chen | |
| D692,183 | S | 10/2013 | Lai | |
| 8,888,309 | B1 * | 11/2014 | Foo | A45C 15/06 362/154 |
| D729,521 | S | 5/2015 | Ashry | |
| D754,969 | S | 5/2016 | Godshaw | |
| 2005/0053312 | A1 * | 3/2005 | Hankins | A45C 3/00 383/4 |
| 2005/0247591 | A1 | 11/2005 | Peterson | |
| 2011/0061675 | A1 | 3/2011 | McKinley | |

OTHER PUBLICATIONS http://www.layngo.com/products.php#cosmo; accessed Aug. 22, 2013; (6 pages).
Non-Final Office Action for Design U.S. Appl. No. 29/529,302 dated Mar. 9, 2017 (23 pages).

* cited by examiner

CARRYING CASE

CROSS-REFERENCE TO RELATED APPLICATIONS

The subject patent application claims priority to and all the benefits of U.S. Provisional Patent Application No. 62/029,122 filed on Jul. 25, 2014, which is herein incorporated by reference in its entirety.

BACKGROUND

1. Field of the Disclosure

The present disclosure relates to a carrying case for storing and transporting articles.

2. Description of the Related Art

Carrying cases can be used to store, organize, and/or transport relatively small articles. As one example, a carrying case may be designed to store and transport cosmetic items and/or toiletries during travel. During travel, for example, a traveler may have restrictions on luggage space due to practical considerations of hauling large luggage, transportation requirements, e.g., airline luggage size requirements, etc. As such, some carrying cases are too large to effectively store and transport cosmetic items and/or toiletries.

In addition, the environment for using the contents of the carrying case during travel or at a destination may be far from ideal. For example, during travel or at a destination, the carrying case may be used at a sink of a bathroom, or restroom. The counter space of the sink may be limited, especially if more than one traveler is actively using the counter space and/or has personal items stored on the counter space. In addition, an item of the carrying case that is removed for use may easily fall into the sink and down the drain, especially if the traveler is operating in limited space.

As such, there remains an opportunity to design a carrying case that has a reduced size conducive for travelling and that is provides easy access and use of the contents of the carrying case.

SUMMARY OF THE DISCLOSURE AND ADVANTAGES

A carrying case comprises a first storage unit and a second storage unit. The second storage unit is moveable away from the first storage unit from a stowed position to an extended position to define a gap between the first storage unit and the second storage unit in the extended position. A tray extends across the gap from the first storage unit to the second storage unit. At least a portion of the tray is disposed in the second storage unit in the stowed position and extends along the gap in the extended position.

Since the tray extends across the gap from the first storage unit to the second storage unit in the extended position, contents may be removed from the first storage unit and/or the second storage unit and supported on the tray. In addition, since at least a portion of the tray is disposed in the second storage unit in the stowed position, the carrying case may assume a compact size that is more easily transported and/or packed for transportation.

BRIEF DESCRIPTION OF THE DRAWINGS

Other advantages of the present disclosure will be readily appreciated, as the same becomes better understood by reference to the following detailed description when considered in connection with the accompanying drawings wherein.

DETAILED DESCRIPTION

Figure 1:
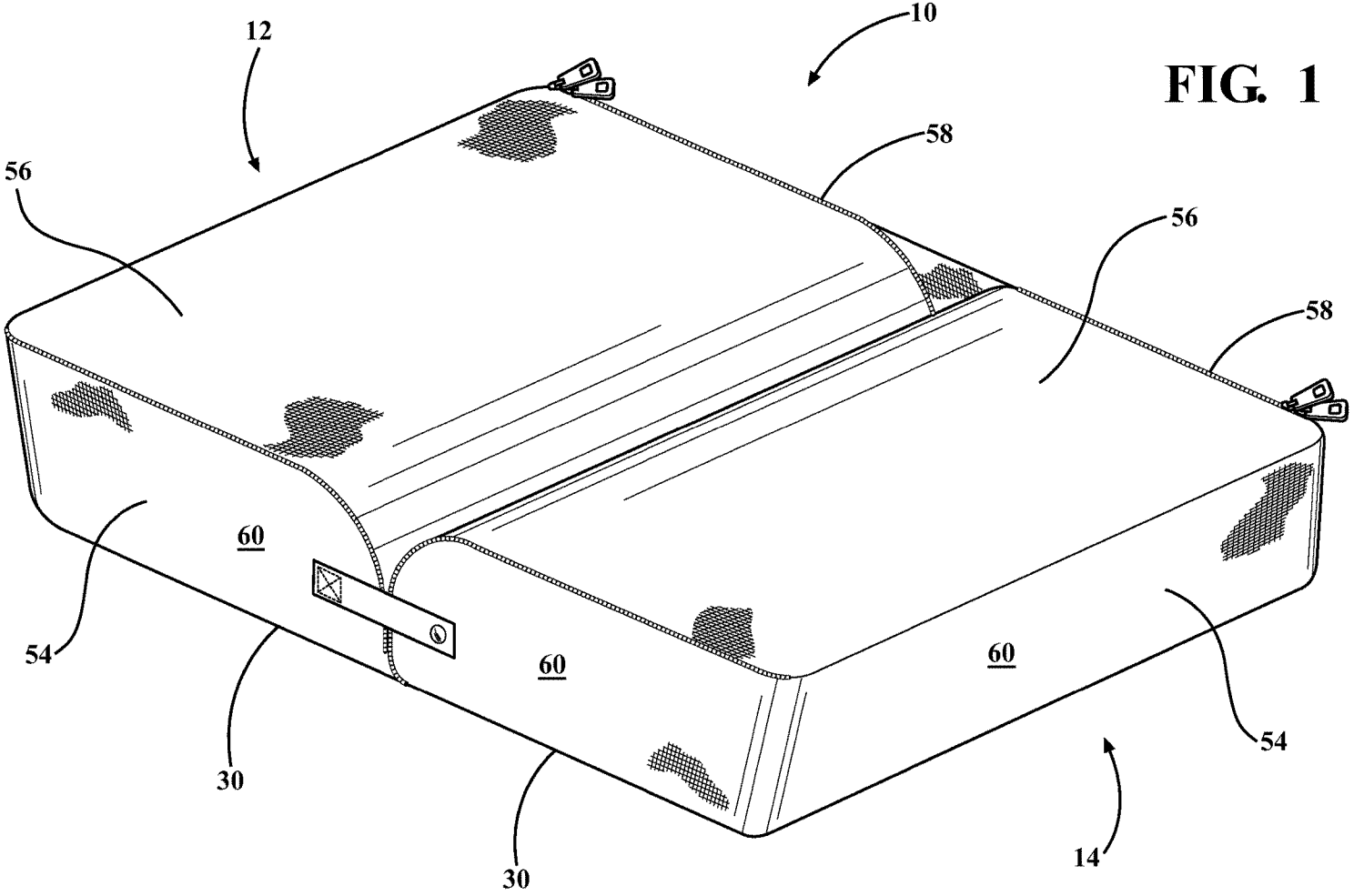
FIG. 1 is a perspective view of a carrying case in a stowed position.
Figure 2:
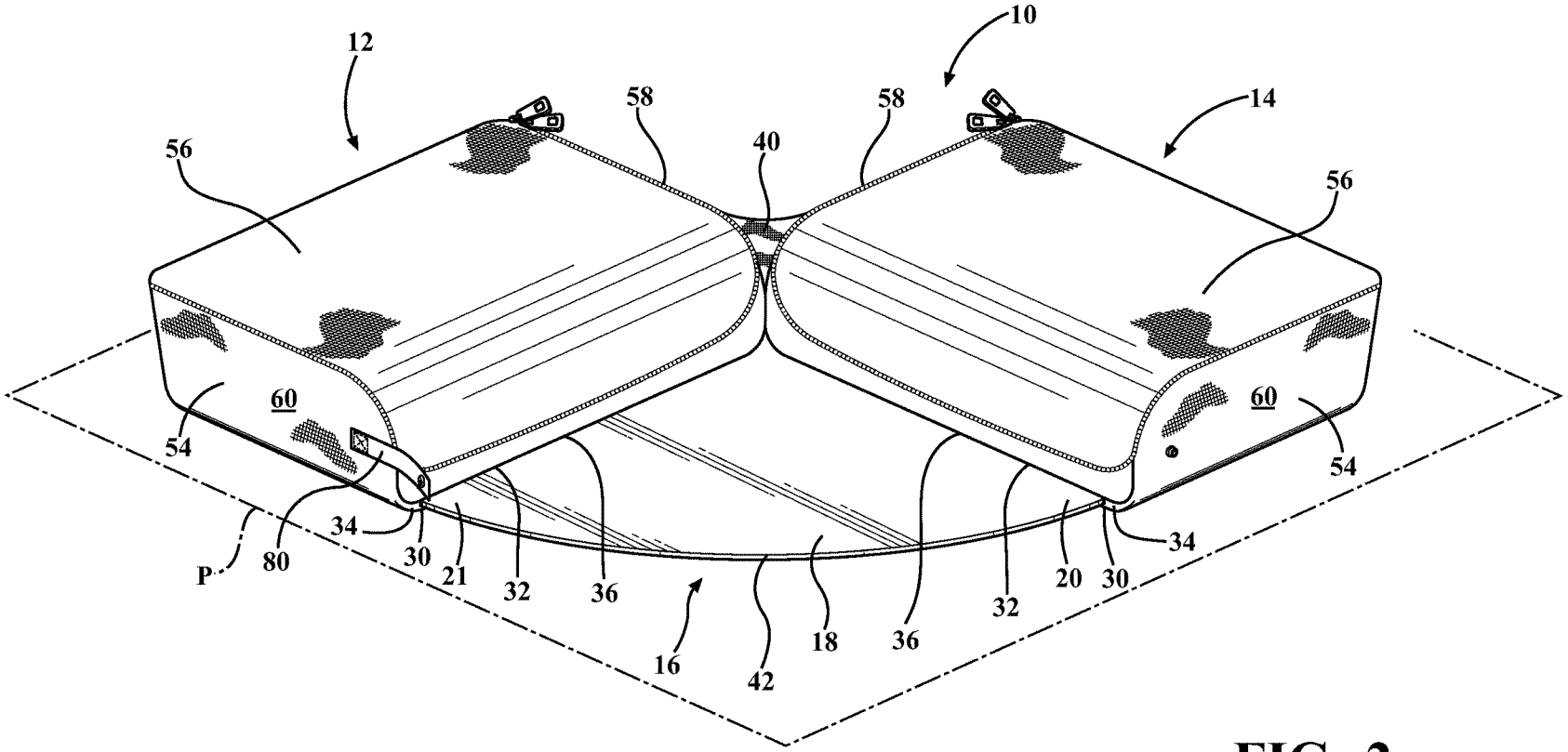
FIG. 2 is a perspective view of the carrying case in an extended position with lids of first and second storage units in a closed position.
Figure 3:
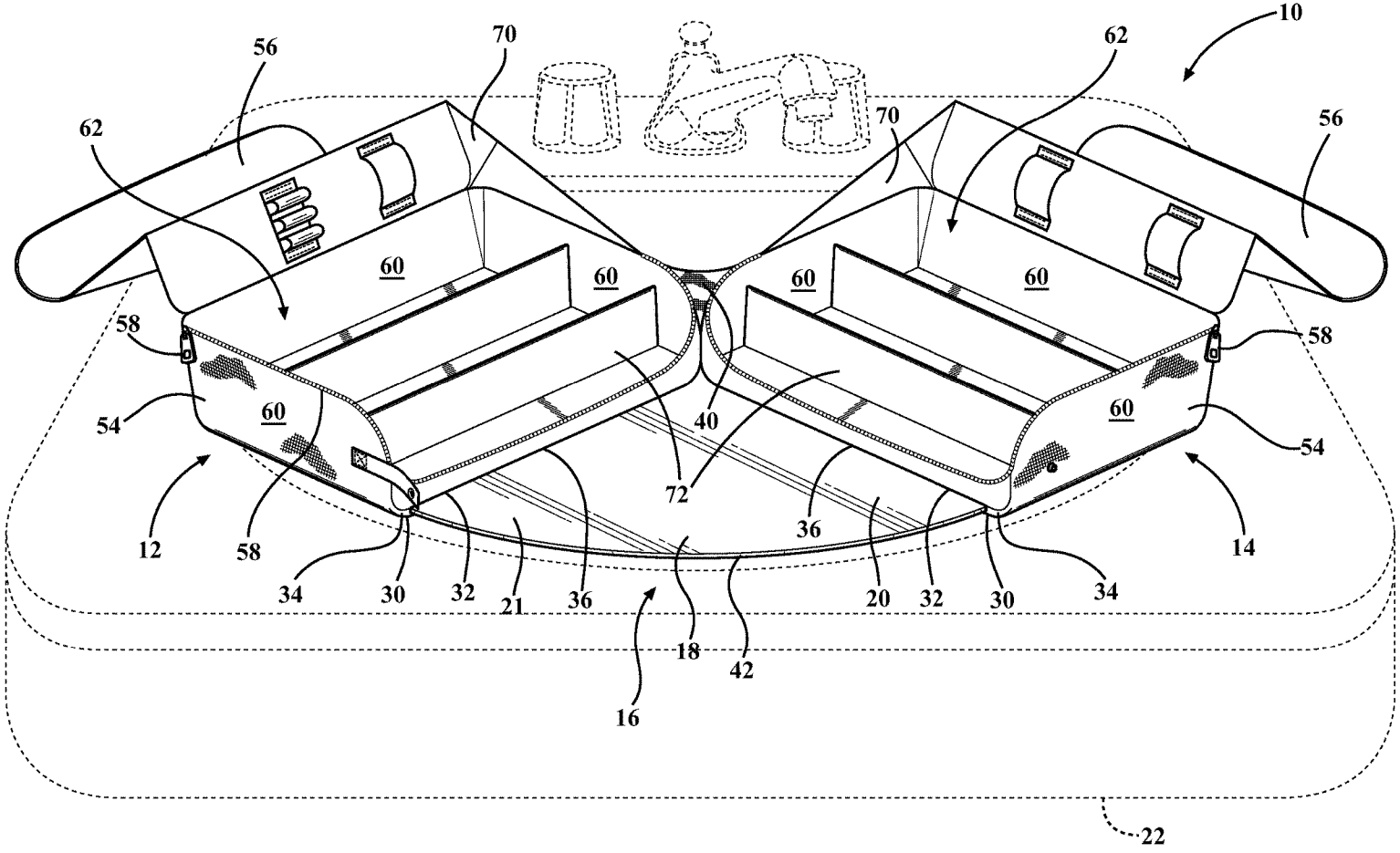
FIG. 3 is a perspective view of the carrying case in the extended position with the lids in the open position.

With reference to the Figures, wherein like numerals indicate like parts throughout the several views, a carrying case 10, 110 includes a first storage unit 12 and a second storage unit 14. The second storage unit 14 is moveable away from the first storage unit 12 from a stowed position, as shown in FIG. 1, to an extended position, as shown in FIGS. 2-3, to define a gap 16 between the first storage unit 12 and the second storage unit 14 in the extended position. A tray 18, 118 extends across the gap 16 from the first storage unit 12 to the second storage unit 14. At least a portion 20 of the tray 18, 118 is disposed in the second storage unit 14 in the stowed position and extends along the gap 16 in the extended position.

Since the tray 18, 118 extends across the gap 16 from the first storage unit 12 to the second storage unit 14, contents may be removed from the first storage unit 12 and/or the second storage unit 14 and supported on the tray 18, 118. For example, cosmetic products may be stored in the first storage unit 12 and/or the second storage unit 14. As set forth further below, the first storage unit 12 and the second storage unit 14 may rest on sides of a bathroom sink 22 (shown for example in broken lines in FIG. 3) such that the tray 18, 118 extends across the bathroom sink 22. The tray 18, 118 may be used to support the cosmetic products and prevent the cosmetic products from falling into the sink 22. In other words, the tray 18, 118 extends counter surface of the sink 22. Since at least a portion 20 of the tray 18, 118 is disposed in the second storage unit 14 in the stowed position, the carrying case 10, 110 may assume a compact size that is more easily transported and/or packed for transportation.

Figure 4:
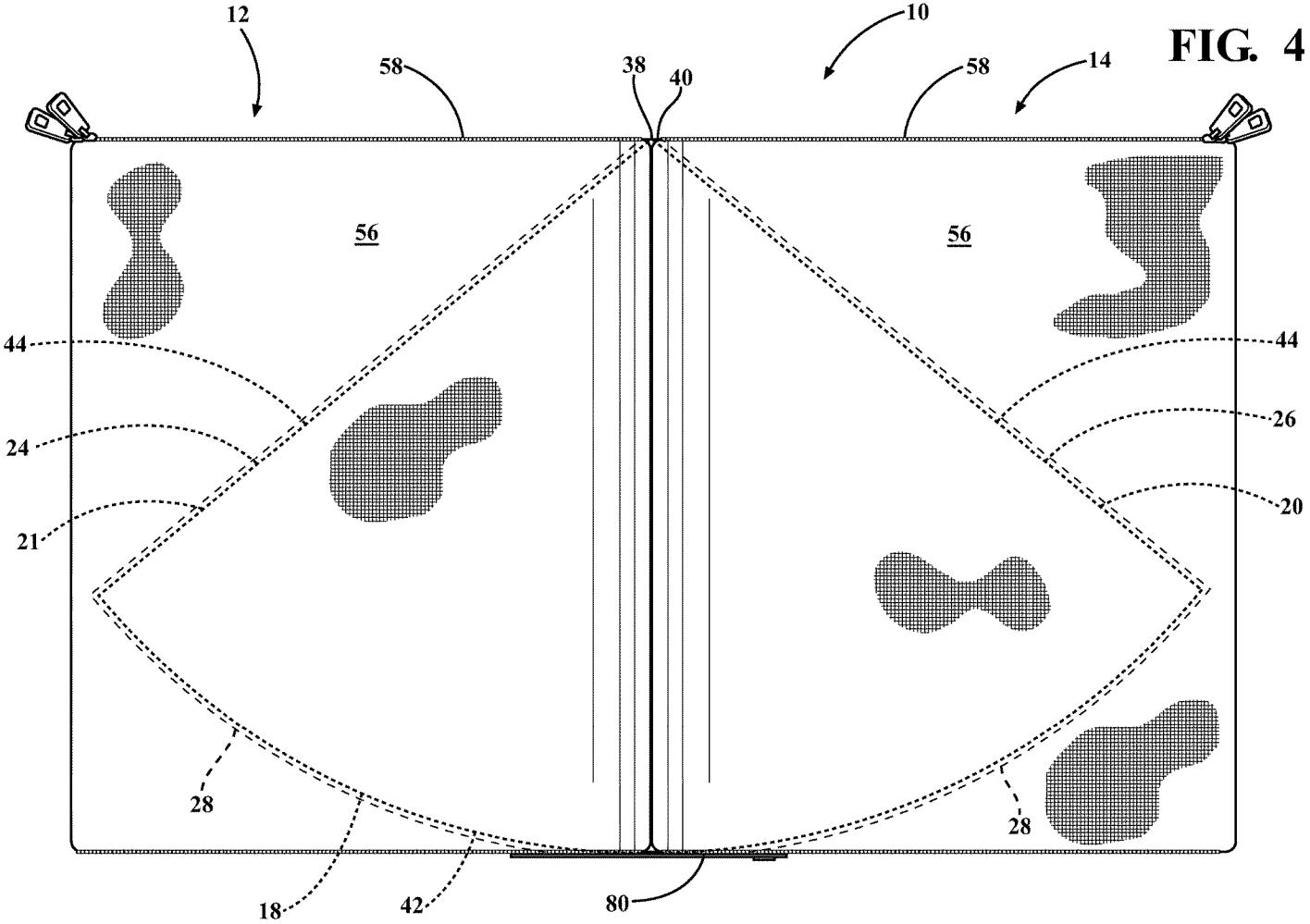
FIG. 4 is a top view of the carrying case in the stowed position with portions of a tray disposed in the first and second storage units shown in hidden lines.
Figure 5:
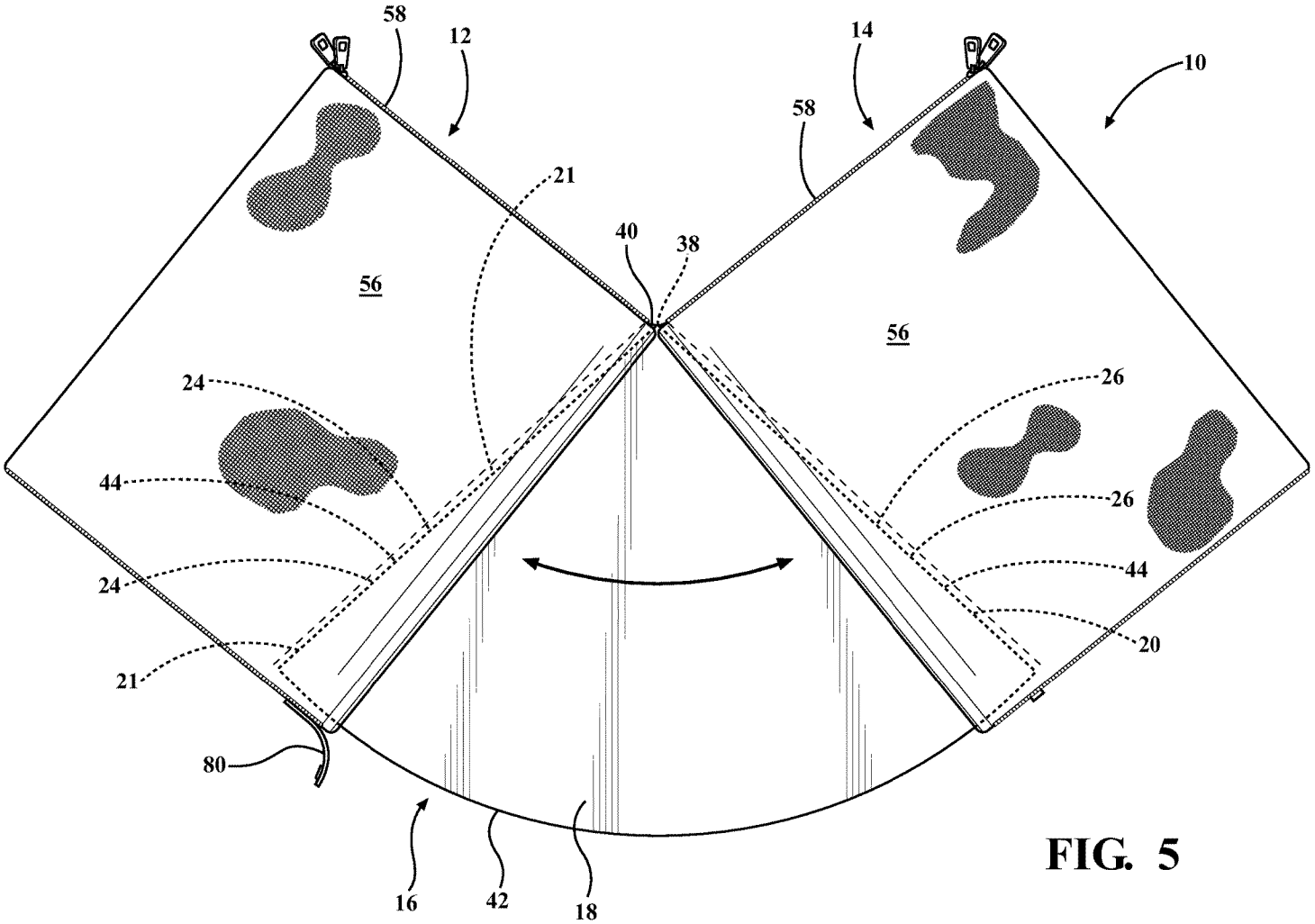
FIG. 5 is a top view of the carrying case in the extended position with portions of the tray disposed in the first and second storage units shown in hidden lines.
Figure 6:
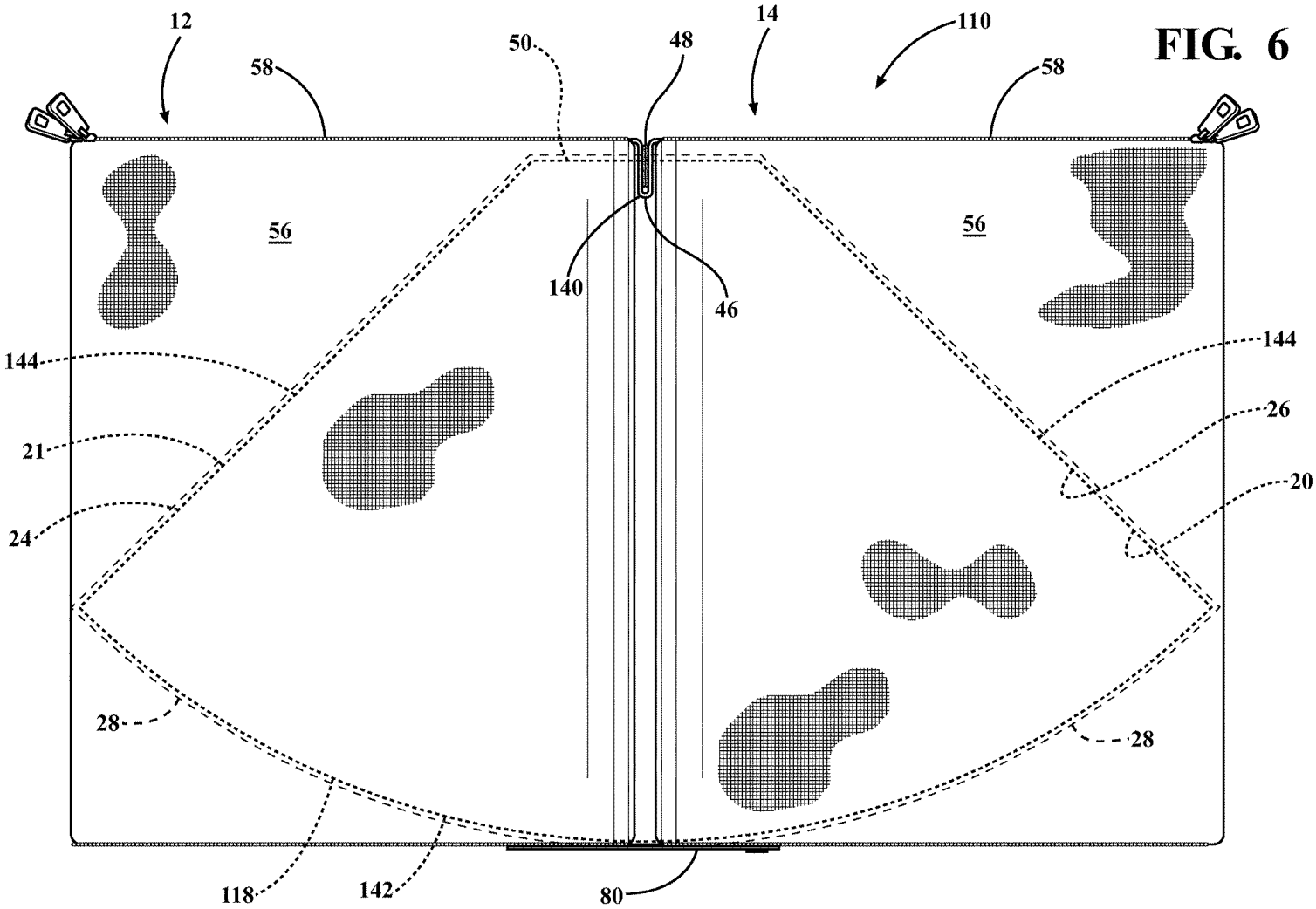
FIG. 6 is a top view of a second embodiment of the carrying case in the stowed position with the tray shown in hidden lines and including a base and with a fold between the first and second storage units.
Figure 7:
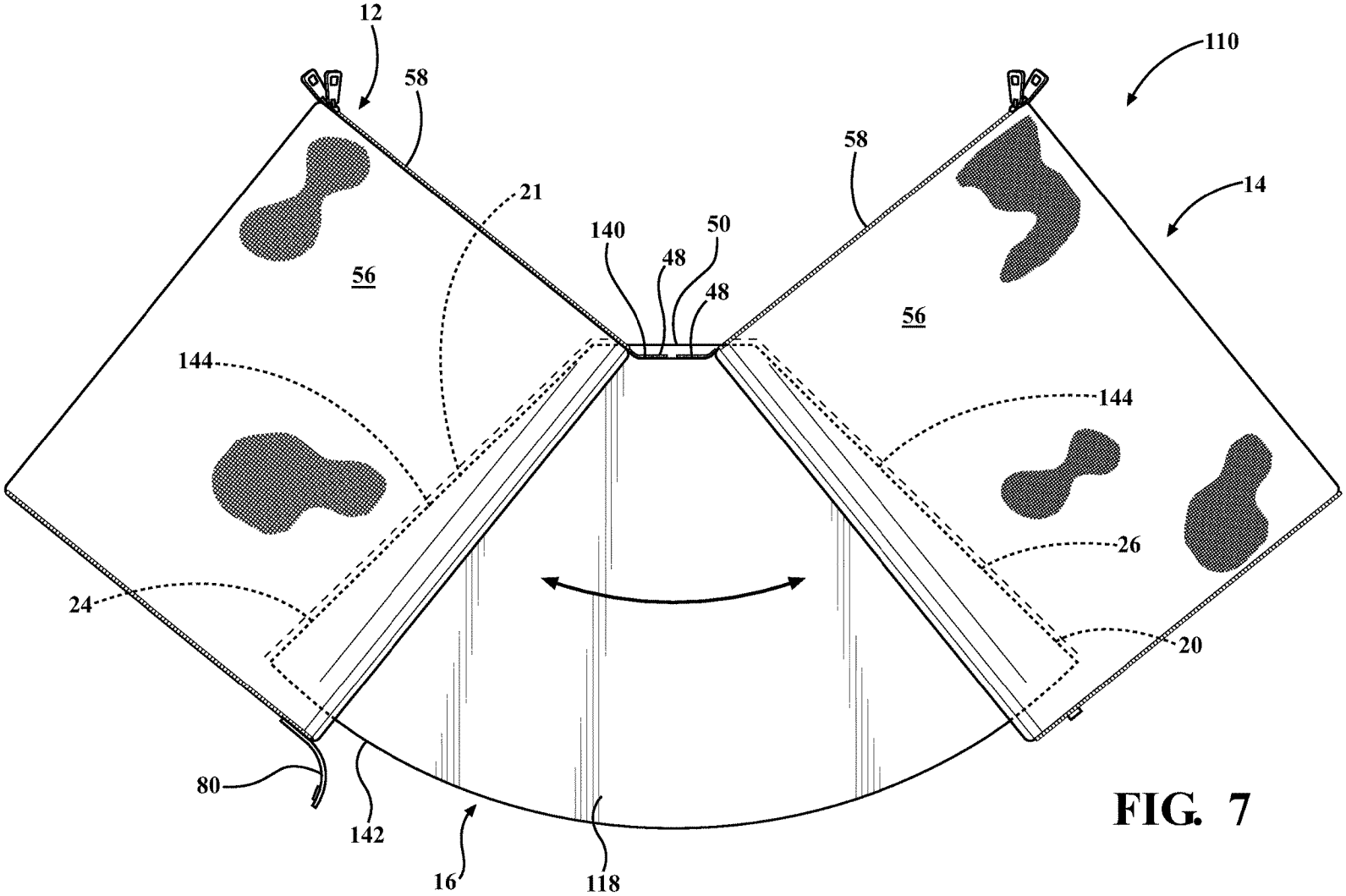
FIG. 7 is a top view of the carrying case of FIG. 6 with the first and second storage units spaced from each other along the base and pivoted relative to each other in the extended position.

As set forth further below, a first embodiment of the carrying case 10 is shown in FIGS. 1-5 and a second embodiment of the carrying case 110 is shown in FIGS. 6-7. Common numerals are used to identify common features in both embodiments. As set forth further below, the first embodiment includes tray 18 and the second embodiment includes tray 118. The tray 18, 118 may be configured to support the first storage unit 12 and the second storage unit 14 when the first storage unit 12 and the second storage unit 14 are in the extended position, i.e., such that the tray 18, 118 supports the weight of the first storage unit 12 and the second storage unit 14 in the extended position without substantially bending or buckling. The tray 18, 118 may have any suitable thickness and, for example, may be thin relative to the first storage unit 12 and the second storage unit 14. The tray 18, 118 may be formed of any suitable material. For example, the tray 18, 118 may be formed of a polymer such as ethylene vinyl acetate (EVA) or any other polyolefin elastomer or copolymer of ethylene. The tray 18, 118 may include a woven covering, e.g., fabric, film, etc.

With reference to FIGS. 1 and 2, both the first storage unit 12 and the second storage unit 14 may be moveable relative to the tray 18 from the stowed position to the extended position. In this configuration, the first storage unit 12 and the second storage unit 14 may move independently from each other relative to the tray 18, i.e., the first storage unit 12 may move between the stowed position and the extended position regardless of the position of the second storage unit 14, and the second storage unit 14 may move between the stowed position and the extended position regardless of the position of the first storage unit 12. Alternatively the tray 18 may be fixed to the first storage unit 12 and the second storage unit 14 may be moveable relative to the tray 18 to extend from and retract into the second storage unit 14. It should be appreciated that the terms "first" and "second" are used herein merely as identifiers for the storage units and are not intended to infer order or importance.

With continued reference to FIGS. 1 and 2, as set forth above, at least a portion of the tray 18 is disposed in the second storage unit 14 in the stowed position and extends along the gap 16 in the extended position. Similarly, at least another portion 21 of the tray 18 may be disposed in the first storage unit 12 in the stowed position and extend along the gap 16 in the extended position. When the portions 20, 21 of the tray 18 extend along the gap 16 when the first storage unit 12 and the second storage unit 14 are in the extended position, the portions 20, 21 of the tray 18 are exposed between the first storage unit 12 and the second storage unit 14.

The tray 18 may include a first end 24 that remains in the first storage unit 12 when the first storage unit 12 is in the extended position and a second end 26 that remains in the second storage unit 14 when the second storage unit 14 is in the extended position. For example, the first end 24 and the second end 26 may include stops S1 and S2 (FIGS. 4 and 5), e.g., flanges, tethers, etc., that prevent the first end 24 and the second end 26 from exiting the first storage unit 12 and the second storage unit 14, respectively.

With reference to FIGS. 2 and 3, the tray 18 may extend along a plane P and may support the first storage unit 12 and the second storage unit 14 in the plane P in the extended position. As such, the first storage unit 12 and/or the second storage unit 14 may be supported on a surface, e.g., an edge of a sink, and the tray 18 may extend across a recess, e.g., a basin of the sink, and, since the tray 18 supports the first storage unit 12 and the second storage unit 14 in the plane, the tray 18 supports the carrying case 10 above the basin. The first storage unit 12 and the second storage unit 14 move along the plane P between the stowed position and the extended position.

With continued reference to FIGS. 2-3, the first storage unit 12 and the second storage unit 14 define each define a track 28 slideably receiving the tray 18. The tray 18 slides 56 along the track 28 as the first storage unit 12 and the second storage unit 14. The track 28, for example, may be defined between a bottom panel 30 and an upper surface 32 with the tray 18 disposed between the bottom panel 30 and the upper surface 32. Sides 34 may connect the bottom panel 30 and the upper surface 32. The track 28 may match the shape of the tray 18, as shown in FIGS. 4-7. Alternatively, the track 28 may be of any suitable configuration.

With reference to FIGS. 2-3, the first storage unit 12 and the second storage unit 14 may each define a slot 36 slideably 56 receiving the tray 18. The slot 36 may be in communication with the track 28. The slot 36 of the first storage unit 12 and the second storage unit 14 face each other in the stowed position.

With reference to FIGS. 4 and 5, the first storage unit 12 and the second storage unit 14 are pivotally coupled and pivot relative to each other from the stowed position to the extended position. The first storage unit 12 and the second storage unit 14 may, for example, pivot about a corner 38 of the tray 18, 118.

With continued reference to FIGS. 4 and 5, the carrying case 10 may include a connector 40 coupled to the first storage unit 12 and the second storage unit 14. The first storage unit 12 and the second storage unit 14 pivot relative to each other about the connector 40. The connector 40 may be configured in any suitable way to allow the first storage unit 12 and the second storage unit 14 to pivot relative to each other. For example, the connector 40 may be formed of a material that is flexible relative to the first storage unit 12, the second storage unit 14, and/or the tray 18, 118. The connector 40 may, for example, be any suitable type of natural or synthetic fabric, film, etc., such as nylon, polyester, etc.

With continued reference to FIGS. 4 and 5, the tray 18, 118 may have a circular sector shape, i.e., pie-shaped. Specifically, the circular sector shape may include an arc 42 and two radii 44 extending from the arc 42 to the corner 38. As set forth above, the first storage unit 12 and the second storage unit 14 may pivot about corner 38 between the stowed position and the extended position. As the first storage unit 12 and the second storage unit 14 pivot about the corner 38, the first storage unit 12 and the second storage unit 14 may slide 56 along the arc 42. Alternatively, the tray 18 may have any suitable configuration to allow the first storage unit 12 and the second storage unit 14 to pivot relative to each other between the stowed position and the extended position. As one example, the tray 18 may have a half circle shape such that the first storage unit 12 and the second storage unit 14 may each move at 90° away from each other to the extended position.

With reference to FIGS. 6 and 7, the first storage unit 12 and the second storage unit 14 of the second embodiment may pivot relative to each other and translationally move relative to each other from the stowed position to the extended position. The connector 140 of the second embodiment may be configured to allow the first storage unit 12 and the second storage unit 14 to pivot and translate relative to each other. For example, the connector 140 may include a fold 46 between the first storage unit 12 and the second storage unit 14 in the stowed position. As shown in FIG. 7, the connector 140 may unfold as the first storage unit 12 and the second storage unit 14 move to the extended position.

With continued reference to FIGS. 6 and 7, the carrying case 110 may include a fastener 48 in the fold 46. The fastener 48 may be, for example, hook and loop fasteners, i.e., hook and pile fasteners. When the first storage unit 12 and the second storage unit 14 move relative to each other from the stowed position to the extended position, the hook and loop fasteners disengage each other. When the first storage unit 12 and the second storage unit 14 move relative to each other from the extended position to the stowed position, the hook and loop fasteners engage each other to releasably retain the first storage unit 12 and the second storage unit 14 in the stowed position.

With continued reference to FIGS. 6 and 7, the tray 118 may have a truncated circular sector shape, i.e., a circular sector shape with a corner removed. Specifically, the truncated circular sector shape may include an arc 142, a base 50, and two radii 144 extending from the arc 142 to the base 50. The first storage unit 12 and the second storage unit 14 may pivot about the base 50 and may slide 56 along the base 50 as the first storage unit 12 and the second storage unit 14 move between the stowed position and the extended position. As the first storage unit 12 and the second storage unit 14 pivot and translate relative to the base 50, the first storage unit 12 and the second storage unit 14 may slide 56 along the arc 142. Alternatively, the tray 118 may have any suitable configuration to allow the first storage unit 12 and the second storage unit 14 to pivot and translate relative to each other between the stowed position and the extended position.

The first embodiment and/or the second embodiment of the carrying case 10, 110 may include a strap 80 or other connecting feature that engages the first storage unit 12 and the second storage unit 14 to selectively retain the first storage unit 12 and the second storage unit 14 in the stowed position. The strap 80 may be releasably attached to one of the first storage unit 12 and the second storage unit 14 and may be permanently attached to the other of the first storage unit 12 and the second storage unit 14. The strap 80 shown in the Figures, for example, is permanently stitched to the first storage unit 12 and is releasably fixed to the second storage unit 14 with a snap (not numbered). The strap 80 may be connected to any portion of the first storage unit 12 and the second storage unit 14. The carrying case 10, 110 may include any suitable number of straps 80. Alternatively, the strap 80 may include hook and loop fasteners, clips, buttons, etc.

With reference to FIG. 3, the first storage unit 12 and the second storage unit 14 each may define a compartment 54 and lid 56 removeably covering the compartment 54. The lid 56 is shown in cross-section in FIG. 8. As shown in FIG. 3, the lid 56 may be hinged to the compartment 54. The lid 56 may be closed to the compartment 54 with a zipper 58 or other suitable closing feature.

The compartment 54 may include a plurality of walls 60 defining a cavity 62. The compartment 54 may be formed of any suitable material such as natural or synthetic fabric, film, etc., such as nylon, polyester, etc. The compartment 54 may include reinforcing features for maintaining the shape of the walls 60. The reinforcing features may be of any suitable shape, such as, foam.

Figure 8:
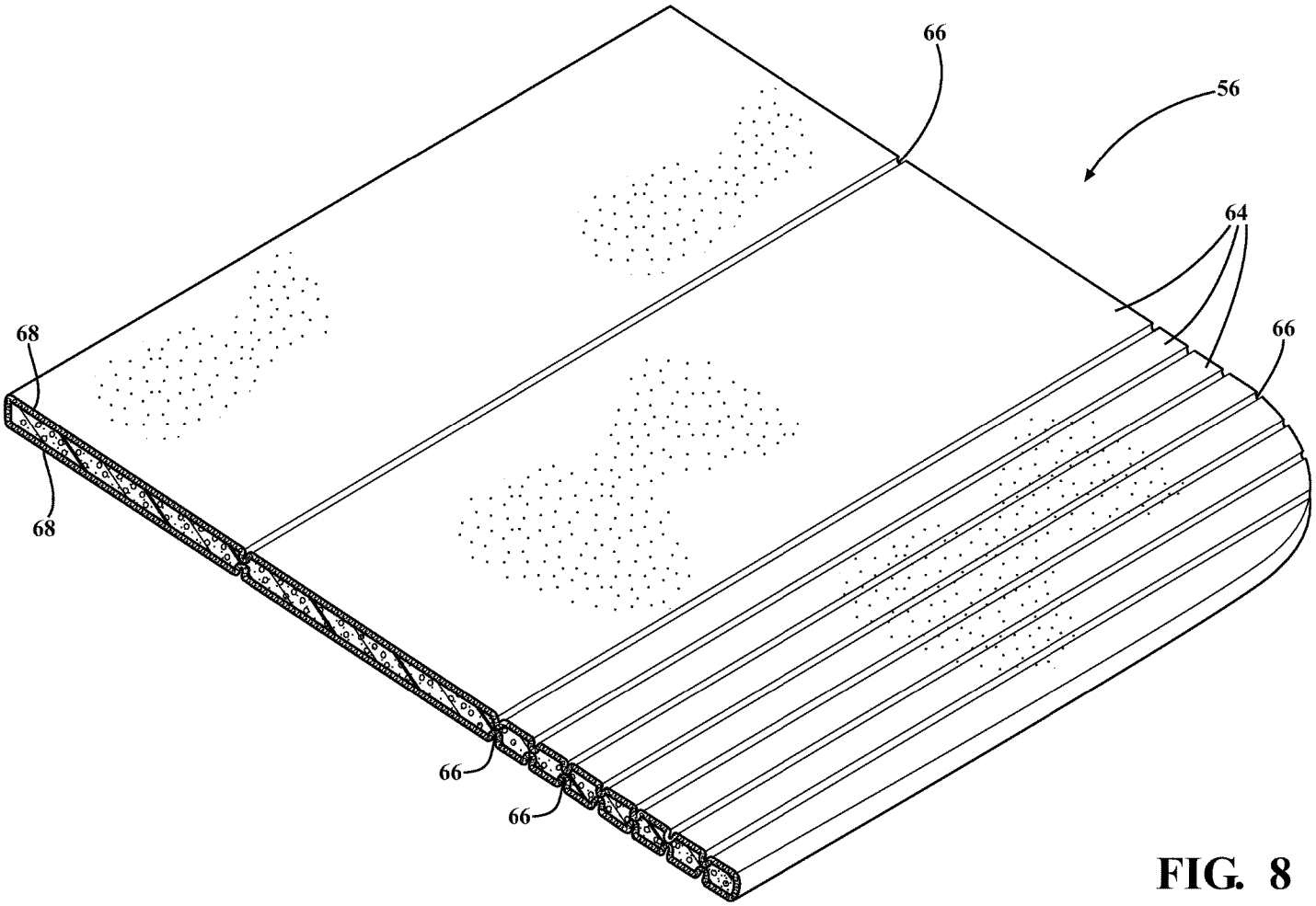
FIG. 8 is a cross-sectional view of the lid of one of the first and second storage units.
Figure 9:
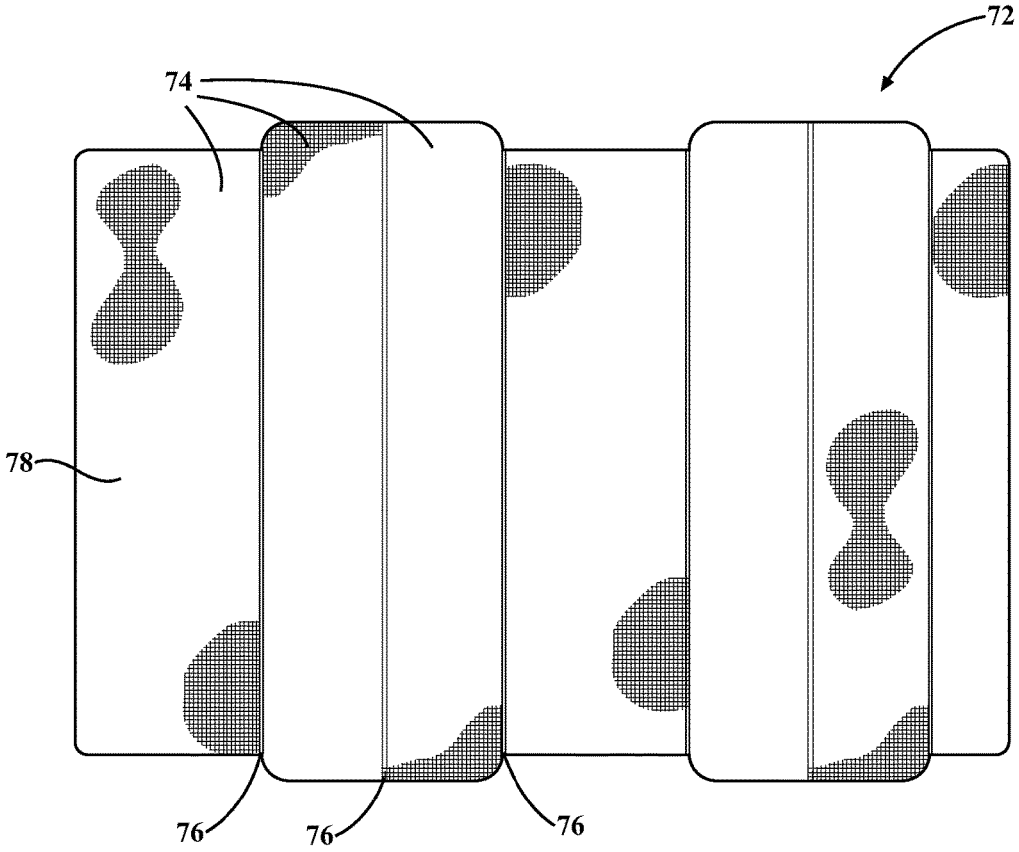
FIG. 9 is a top view of a divider of one of the first and second storage units.

As shown in FIGS. 3 and 8, the lid 56 may include segments 64 separated by living hinges 66. For example, the segments 64 may be sandwiched between two outer layers 68, e.g., fabric, film, etc. The outer layers 68 may define the living hinges 66 between the segments 64. The outer layers 68 may be of any suitable type of natural or synthetic fabric, film, etc., such as nylon, polyester, etc. The outer layers 68 may be the same as or different than the material of the connector 40, 140. The segments 64 may be any suitable material, such as, foam.

With reference to FIG. 3, the first storage unit 12 and the second storage unit 14 may each include a tether 70 for limiting the movement of the lid 56 relative to the compartment 54. The tether 70, for example, may be fixed to the lid 56 and to the compartment 54. The tether 70 may fold between the lid 56 and the compartment 54 when the lid 56 is closed to the compartment 54 and, as shown in FIG. 3, the tether 70 may unfold to limit movement of the lid 56 when the lid 56 is open. Alternatively, the tether 70 may have any suitable configuration. The tether 70, the connector 40, 140, and/or the compartment 54 may each be formed of a common type of material. In addition, the tether, the connector 40, 140, and/or the compartment 54 may each be integrally formed with each other, i.e., formed simultaneously from a single piece of material. Alternatively, the tether 70, the connector 40, 140, and the compartment 54 may be formed separately and subsequently assembled together.

As shown in FIGS. 3 and 8, the first storage unit 12 and the second storage unit 14 may each include a divider 72 in the cavity 62 of the compartment 54. As shown in FIG. 3, the divider 72 divides the compartment 54 to store various items.

As shown in FIG. 8, the dividers 72 may be removed from the first storage unit 12 and the second storage unit 14. The dividers 72 may include segments 74 and living hinges 76 connecting the segments 74. For example, the segments 74 may be sandwiched between two outer layers 78. The outer layers 78 may define the living hinges 76 between the segments 74. The outer layers 78 may be of any suitable type of natural or synthetic fabric, film, etc., such as nylon, polyester, etc. The outer layers 78 may be the same as or different than the material of the connector 40, 140. The segments 74 may be any suitable material, such as, foam.

In use, items such as, for example, cosmetics, toiletries, etc., may be loaded into and stored in the compartment 54 of the first storage unit 12 and/or the second storage unit 14. The lids 56 may be closed relative to the compartments 54 to retain the items in the first storage unit 12 and/or the second storage unit 14. The first storage unit 12 and the second storage unit 14 may be moved to the stowed position, as shown in FIG. 1, to store the carrying case 10, 110 and/or to travel with the carrying case 10, 110. In the stowed position, for example, the carrying case 10, 110 may be sized to fit within a 21 inch suitcase, or any other standard sized suitcase.

When at a chosen destination, the first storage unit 12 and/or the second storage unit 14 may be moved from the stowed position to the extended position with the tray 18, 118 extending from the first storage unit 12 to the second storage unit 14. The first storage unit 12 and the second storage unit 14 may, for example, be rested on edges of a sink with the tray 18, 118 extending across the basin of the sink. The lid 56 of the first storage unit 12 and/or the second storage unit 14 may be opened to access the items in the compartments 54. The items may be placed on the tray 18, 118 during use. The tray 18, 118 adds usable space to the sink to rest the items and may catch items that are accidentally dropped to prevent loss of the items down the drain of the sink.

The use of the carrying case 10, 110 is not limited to cosmetics and toiletries. For example, the carrying case 10, 110 may be used to store and/or transport medication, hearing aids, etc., and the tray 18, 118 may be used to set out medication to be consumed and/or to catch any medication that is accidentally dropped. As another example, the carrying case 10, 110 may be used to store items inside an automobile, e.g., tools, spare parts, etc., and the tray 18, 118 may be used to support the parts when work is performed on the automobile. Another example use includes storing and/or transporting toys, in which case the tray 18, 118 may be used as a surface to set the toys and/or play with the toys in a home setting and/or during travel. As another example, the carrying case 10, 110 may be used to store and transport food, e.g., as a lunch box, in which case the tray 18, 118 may be used to set the food during consumption.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A carrying case comprising:

a first storage unit;

a second storage unit moveable away from the first storage unit from a stowed position to an extended position to define a gap between the first storage unit and the second storage unit in the extended position;

a connector formed of fabric and extending from the first storage unit to the second storage unit, the first and second storage units being flexibly coupled by said connector so as to be pivotable relative to each other about the connector between the stowed position and the extended position; and a tray extending across the gap from the first storage unit to the second storage unit wherein said tray, said first storage unit and said second storage unit in said extended position extend along a plane, wherein at least a first portion of the tray being disposed in the first storage unit in the stowed position and extends along the gap in the extended position, and at least a second portion of the tray being disposed in the second storage unit in the stowed position and extending along the gap in the extended position, said first portion and said second portion terminating at respective first and second ends, which include respective stops that prevent said first and second ends from exiting said first storage unit and said second storage unit, wherein an entire length of each of said first and second ends remains respectively within and is prevented from exiting the first storage unit and second storage unit when in the extended position such that said tray supports said first storage unit and said second storage unit transverse to said plane in the extended position.

2. The carrying case as set forth in claim 1 wherein the second storage unit defines a track slideably receiving the tray.

3. The carrying case as set forth in claim 2 wherein the second storage unit includes a bottom panel and a compartment, the track being disposed between the bottom panel and the compartment.

4. The carrying case as set forth in claim 2 wherein the first storage unit defines a track slideably receiving the tray.

5. The carrying case as set forth in claim 4 wherein the first storage unit and the second storage unit each include a bottom panel and a compartment, the track being disposed between the bottom panel and the compartment of both the first storage unit and the second storage unit.

6. The carrying case as set forth in claim 2 wherein the first storage unit and the second storage unit each includes a bottom panel and an upper surface fixed to the bottom panel with the track extending from the bottom panel to the upper surface and a slot opening into said track wherein said first and second ends are each received within said track through said slot respectively corresponding thereto to support the first storage unit and the second storage unit transverse to the plane.

7. The carrying case as set forth in claim 6 wherein the second storage unit includes a compartment and wherein the upper surface is between the compartment and the tray.

8. The carrying case as set forth in claim 1 wherein the second storage unit defines a slot slideably receiving the tray.

9. The carrying case as set forth in claim 8 wherein the first storage unit defines a slot slideably receiving the tray and facing the slot of the second storage unit in the stowed position, wherein said slots respectively receive said first and second ends such that said first and second ends of said tray support the weight of said first storage unit and said second storage unit.

10. The carrying case as set forth in claim 1 wherein the connector includes a fold between the first storage unit and the second storage unit in the stowed position.

11. The carrying case as set forth in claim 10 further comprising a fastener in the fold.

12. The carrying case as set forth in claim 1 wherein the first storage unit and the second storage unit translationally move relative to each other from the stowed position to the extended position.

13. The carrying case as set forth in claim 1 wherein the tray has a circular sector shape.

14. The carrying case as set forth in claim 1 wherein the tray has a truncated circular sector shape.

15. The carrying case as set forth in claim 1 wherein the tray extends along said plane and supports the first storage unit and the second storage unit in the plane in the extended position.

16. The carrying case as set forth in claim 1 wherein the first storage unit and the second storage unit each define a compartment and lid removeably covering the compartment.

17. The carrying case as set forth in claim 16 further comprising a divider in the compartments of the first storage unit and the second storage unit, the dividers including segments and living hinges connecting the segments.

18. The carrying case as set forth in claim 1 wherein the first storage unit and the second storage unit are both formed of fabric.

19. A carrying case comprising:

a first storage unit;

a second storage unit moveable away from the first storage unit from a stowed position to an extended position to define a gap between the first storage unit and the second storage unit in the extended position;

a tray extending across the gap from the first storage unit to the second storage unit wherein said tray, said first storage unit and said second storage in said extended position extend along a plane, at least opposite first and second portions of the tray being disposed in the first storage unit and the second storage unit in the stowed position and extending along the gap in the extended position; and a connector coupled to the first storage unit and the second storage unit and wherein the first storage unit and the second storage unit pivot relative to each other about the connector;

wherein the connector includes a fold between the first storage unit and the second storage unit in the stowed position; and said first portion and said second portion terminating at respective first and second ends, which are received within said first storage unit and said second storage and include respective stops that prevent said first and second ends from exiting said first storage unit and said second storage unit wherein an entire length of each of said first and second ends remains respectively within the first storage unit and the second storage unit when in the extended position such that said first and second ends of said tray support said first storage unit and said second storage unit transverse to said plane in the extended position.

20. The carrying case as set forth in claim 19 further comprising a fastener in the fold.

21. A carrying case comprising:

a first storage unit;

a second storage unit moveable away from the first storage unit along a plane from a stowed position to an extended position to define a gap between the first storage unit and the second storage unit in the extended position; and a tray extending along said plane and across the gap from the first storage unit to the second storage unit, at least first and second portions of the tray being disposed respectively in the first storage unit and the second storage unit in the stowed position and extending along the gap in the extended position;

wherein the first storage unit and the second storage unit are pivotally coupled and pivot relative to each other from the stowed position to the extended position; and wherein the first storage unit and the second storage unit also translationally move relative to each other from the stowed position to the extended position; and said first portion and said second portion of said tray terminating at respective first and second ends wherein said first and second ends are received within respective slots in said first storage unit and said second storage unit, and said first and second ends including respective stops that prevent said first and second ends from exiting said first storage unit and said second storage unit wherein an entire length of each of said first and second ends remains within the first storage unit and second storage unit when in the extended position such that receipt of said first and second ends of said tray within said slots supports a weight of said first storage unit and said second storage unit transverse to said plane in the extended position.

* * * * *